US007637357B2

(12) United States Patent
Nakagawa et al.

(10) Patent No.: US 7,637,357 B2
(45) Date of Patent: Dec. 29, 2009

(54) ELEVATOR APPARATUS WITH SHEAVE ROTATIONAL SPEED DIFFERENCE DETERMINATION FOR DETECTING AN ABNORMALITY

(75) Inventors: Hiroyuki Nakagawa, Tokyo (JP); Koei Matsukawa, Tokyo (JP); Yoshikatsu Hayashi, Tokyo (JP); Eiji Ando, Tokyo (JP); Atsushi Mitsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 405 days.

(21) Appl. No.: 11/574,633

(22) PCT Filed: Sep. 9, 2004

(86) PCT No.: PCT/JP2004/013156

§ 371 (c)(1),
(2), (4) Date: Mar. 2, 2007

(87) PCT Pub. No.: WO2006/027841

PCT Pub. Date: Mar. 16, 2006

(65) Prior Publication Data

US 2007/0227826 A1 Oct. 4, 2007

(51) Int. Cl.
*B66B 1/34* (2006.01)

(52) U.S. Cl. ..... 187/393

(58) Field of Classification Search ..... 187/247, 187/391–394
See application file for complete search history.

(56) References Cited

U.S. PATENT DOCUMENTS

| | | | | |
|---|---|---|---|---|
| 3,814,216 | A * | 6/1974 | Pisatowski | 187/393 |
| 7,117,979 | B2 | 10/2006 | Angst et al. | |
| 7,540,358 | B2 * | 6/2009 | Okamoto et al. | 187/394 |
| 2008/0190710 | A1 * | 8/2008 | Shiratsuki et al. | 187/393 |

FOREIGN PATENT DOCUMENTS

| | | | |
|---|---|---|---|
| CN | 1524057 | A | 8/2004 |
| JP | 52-123052 | | 10/1977 |
| JP | 62-205973 | | 9/1987 |
| JP | 62-205973 | A | 9/1987 |
| JP | 2-310280 | | 12/1990 |
| JP | 6-199483 | | 7/1994 |
| JP | 2000-211841 | | 8/2000 |

* cited by examiner

*Primary Examiner*—Jonathan Salata
(74) *Attorney, Agent, or Firm*—Leydig, Voit & Mayer, Ltd.

(57) ABSTRACT

In an elevator apparatus, a main rope suspending a car and a balance weight is looped around a traction sheave and a driven sheave of a traction machine. A driving-side speed detecting portion for detecting rotational speed of the traction sheave and a driven-side speed detecting portion for detecting rotational speed of the driven sheave are electrically connected to an operation control device. The operation control device includes a determination portion determining presence or absence of an abnormality in an elevator by calculating speed difference between rotational speeds of the traction sheave and comparing the speed difference to a fixed reference value, set in advance, and a control portion for controlling the operation of the elevator based on information from the determination portion.

7 Claims, 9 Drawing Sheets

ELEVATOR APPARATUS WITH SHEAVE ROTATIONAL SPEED DIFFERENCE DETERMINATION FOR DETECTING AN ABNORMALITY

TECHNICAL FIELD

The present invention relates to an elevator apparatus of a traction type which is structured such that a car and a counterweight are raised/lowered through driving of a traction machine.

BACKGROUND ART

In a conventional elevator apparatus, a traction machine may be provided with a brake device for braking a rotation of a traction sheave so as to stop a car and a counterweight from running. A main rope for suspending the car and the counterweight is looped around the traction sheave. When the rotation of the traction sheave is braked through operation of the brake device, the running of the car and the counterweight is braked due to a frictional force between the traction sheave and the main rope (see Patent Document 1).

Patent Document 1: JP 2000-211841 A

DISCLOSURE OF THE INVENTION

Problems to be Solved by the Invention

In the conventional elevator apparatus, however, when the frictional force between the traction sheave and the main rope decreases due to, for example, abrasion of a surface of the main rope, and oil, water, dust, or the like adherent to the surface of the main rope, slippage may occur between the traction sheave and the main rope. Thus, some inconveniences are caused. For example, a stop position of the car deviates from a normal stop position, and the car collides with a shock absorber at a bottom of a hoistway.

The present invention has been made to solve the above-mentioned problems, and it is therefore an object of the present invention to obtain an elevator apparatus capable of preventing the occurrence of inconveniences resulting from slippage between a traction sheave and a main rope.

Means for Solving the Problem

An elevator apparatus according to the present invention includes: a traction machine having a traction machine body and a traction sheave adapted to be rotated by the traction machine body; a driven sheave disposed apart from the traction sheave; a main rope looped around the traction sheave and the driven sheave; a car and a counterweight suspended by the main rope; a driving-side speed detecting portion for detecting a rotational speed of the traction sheave; a driven-side speed detecting portion for detecting a rotational speed of the driven sheave; and an operation control device having a determination portion for calculating a speed difference between the rotational speeds of the traction sheave and the driven sheave based on pieces of information from the driving-side speed detecting portion and the driven-side speed detecting portion and comparing the calculated speed difference with a set reference value set in advance to determine presence or absence of an abnormality in an elevator, and a control portion for controlling operation of the elevator based on information from the determination portion.

BEST MODES FOR CARRYING OUT THE INVENTION

Preferred embodiments of the present invention will be described hereinafter with reference to the drawings.

Embodiment 1

Figure 1:
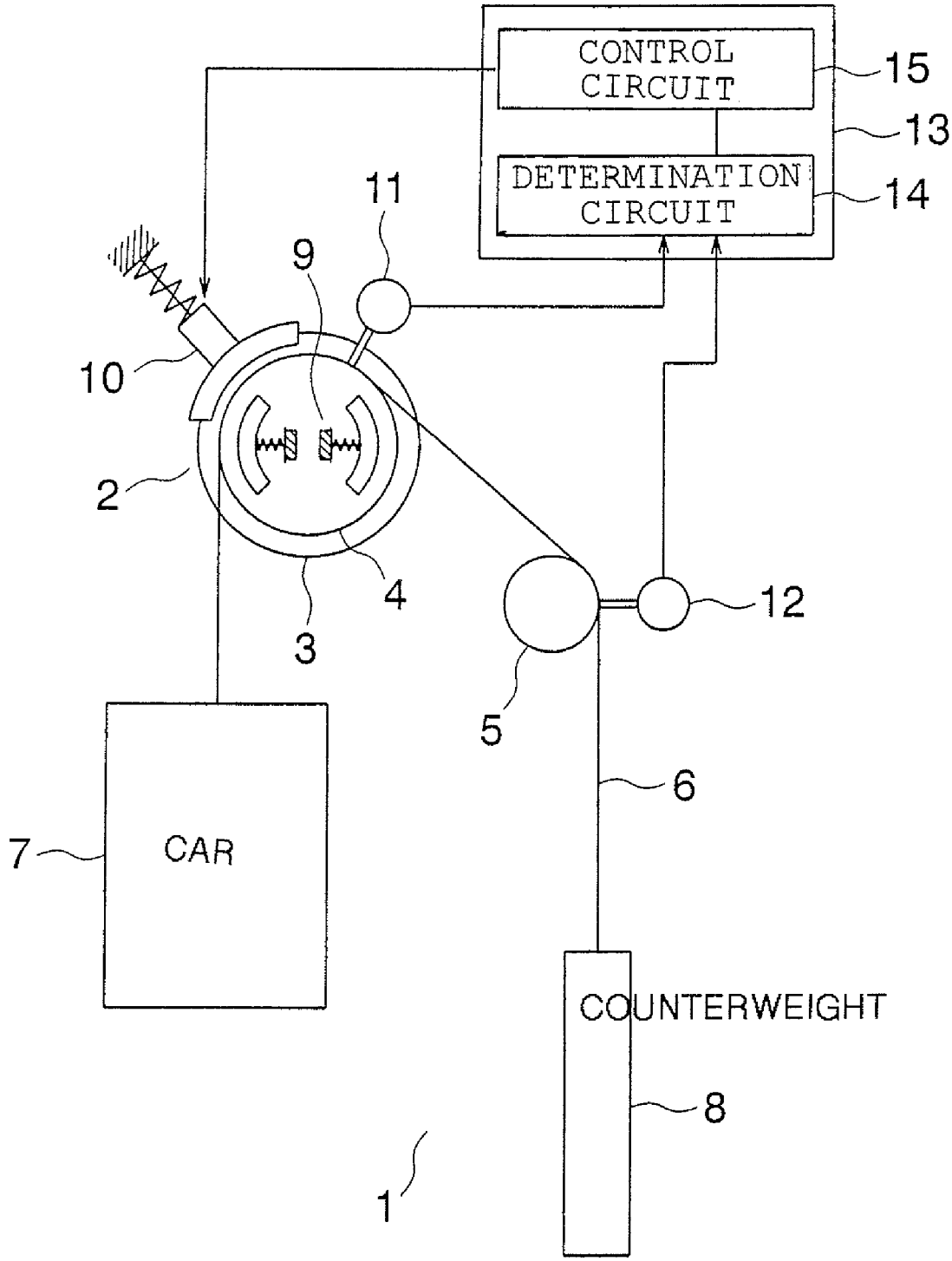
FIG. 1 is a schematic view showing an elevator apparatus according to Embodiment 1 of the present invention.

FIG. 1 is a schematic view showing an elevator apparatus according to Embodiment 1 of the present invention. Referring to FIG. 1, a traction machine 2 is installed in an upper portion of a hoistway 1. The traction machine 2 has a traction machine body 3, and a traction sheave 4 adapted to be rotated by the traction machine body 3. A deflector pulley 5 as a driven sheave disposed apart from the traction sheave 4 is also provided in the upper portion of the hoistway 1. A plurality of main ropes 6 are looped around the traction sheave 4 and the deflector pulley 5. A car 7 and a counterweight 8 are suspended within the hoistway 1 by means of the respective main ropes 6. The respective main ropes 6 are moved through the rotation of the traction sheave 3. The car 7 and the counterweight 8 are raised/lowered through the movement of the respective main ropes 6. The deflector pulley 5 is rotated through the movement of the respective main ropes 6.

The traction machine 2 is mounted with sheave brake devices 9 for braking the rotation of the traction sheave 4, and a rope catch device 10 for gripping the respective main ropes 6 to directly brake the movement thereof. The traction machine 2 is also provided with a traction sheave encoder 11 as a driving-side speed detecting portion for detecting a rotational speed of the traction sheave 4. The deflector pulley 5 is provided with a deflector pulley encoder 12 as a driven-side speed detecting portion for detecting a rotational speed of the deflector pulley 5. For example, a rotary encoder, a tachogenerator, or the like can be mentioned as each of the driving-side speed detecting portion and the driven-side speed detecting portion. Each of the traction sheave encoder 11 and the deflector pulley encoder 12 is electrically connected to an operation control device 13 installed within the hoistway 1.

The operation control device 13 has a determination circuit 14 as a determination portion for determining whether or not there is an abnormality in an elevator, and a control circuit 15 as a control portion for controlling the operation of the elevator based on information from the determination circuit 14.

A set reference value for determining whether or not there is an abnormality in the elevator is set in advance in the determination circuit 14. The determination circuit 14 calculates a speed difference between rotational speeds of the traction sheave 4 and the deflector pulley 5 based on pieces of information from the traction sheave encoder 11 and the deflector pulley encoder 12, and compares the calculated speed difference with the set reference value to determine whether or not there is an abnormality in the elevator. That is, when the speed difference between the rotational speeds of the traction sheave 4 and the deflector pulley 5 is smaller than the set reference value, the determination circuit 14 determines that the elevator is normal (makes normal determination). When the speed difference is equal to or larger than the set reference value, the determination circuit 14 determines that the elevator is abnormal (makes abnormal determination). The determination circuit 14 transmits a determination result, namely, determination information including either the normal determination or the abnormal determination to the control circuit 15. The determination circuit 14 also calculates the rotational speed of the traction sheave 4 based on the information from the traction sheave encoder 11, and transmits stop information to the control circuit 15 when the traction sheave 4 remains stopped from rotating.

The control circuit 15 controls the operation of the elevator based on the determination information and the stop information from the determination circuit 14. That is, when the determination information indicating the abnormal determination or the stop information is input to the control circuit 15 from the determination circuit 14, the control circuit 15 controls the sheave brake devices 9 and the rope catch device 10 in such a manner as to brake the rotation of the traction sheave 4 and the movement of the respective main ropes 6, respectively. When the determination information indicating the normal determination is input to the control circuit 15 from the determination circuit 14, the control circuit 15 controls the sheave brake devices 9 and the rope catch device 10 in such a manner as to cancel the braking of the rotation of the traction sheave 4 and the movement of the respective main ropes 6, respectively.

Figure 2:
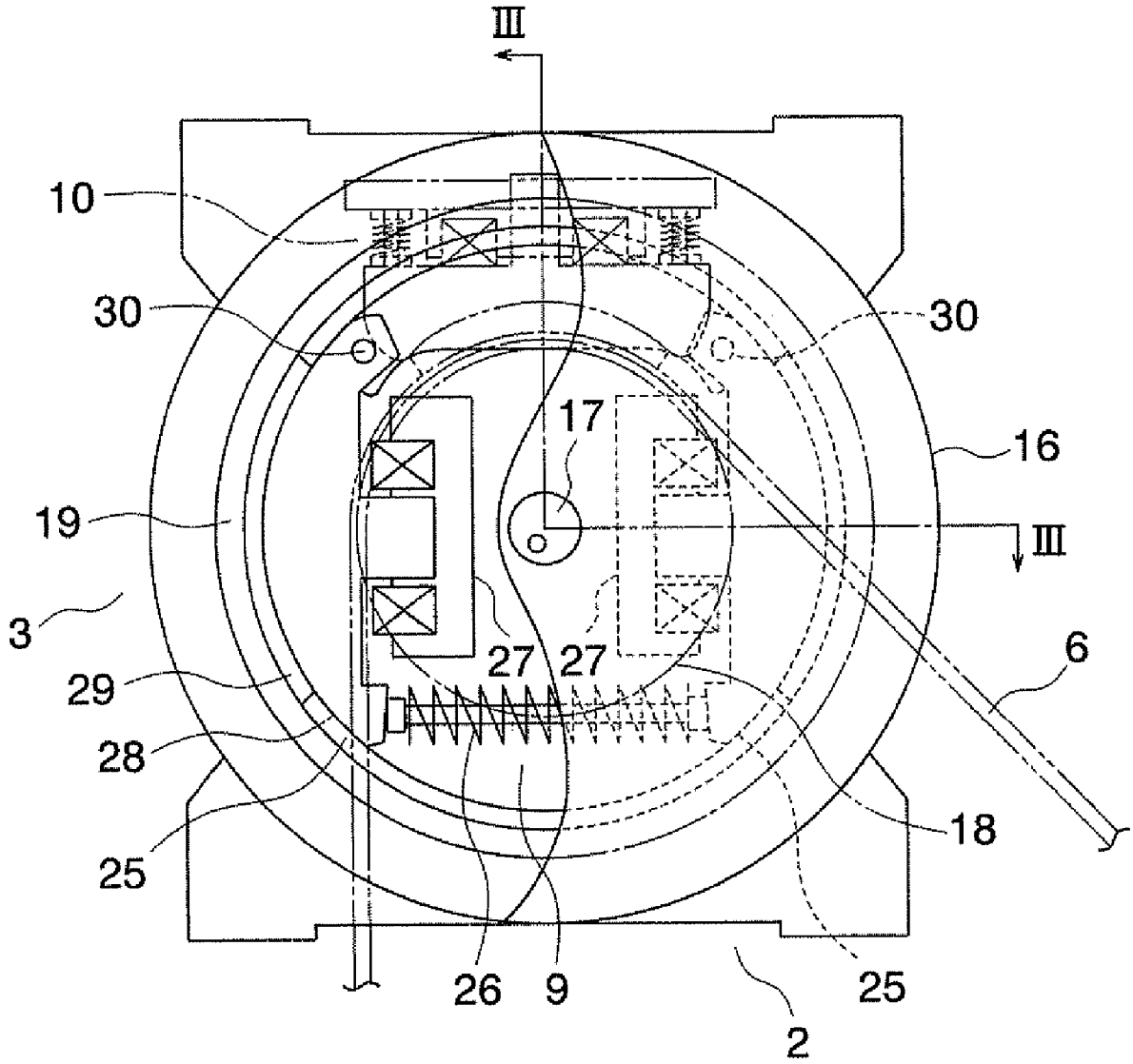
FIG. 2 is a partially broken front view showing the traction machine of FIG. 1.
Figure 3:
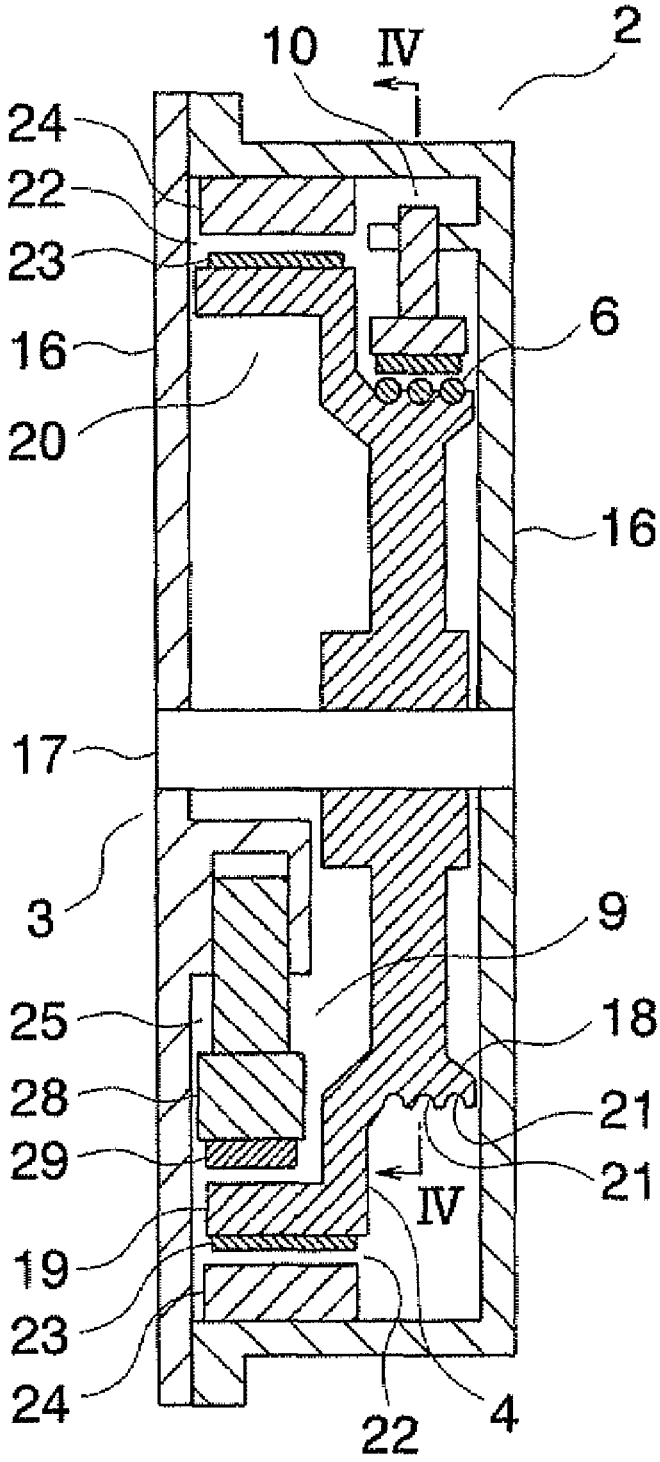
FIG. 3 is a sectional view taken along the line III-O-III of FIG. 2.

FIG. 2 is a partially broken front view showing the traction machine 2 of FIG. 1. FIG. 3 is a sectional view taken along the line III-O-III of FIG. 2. Referring to FIGS. 2 and 3, a horizontally extending main shaft 17 is supported within a traction machine case 16. The traction sheave 4 is rotatably provided on the main shaft 17. The traction sheave 4 is disposed within the traction machine case 16. In addition, the traction sheave 4 has a sheave portion 18 around which the respective main ropes 6 are looped, and an annular portion 19 adjacent to the sheave portion 18 in an axial direction of the main shaft 17. The sheave portion 18 and the annular portion 19 are integrated with each other. A recess portion 20 (FIG. 3) is formed in a lateral portion of the traction sheave 4 by the sheave portion 18 and the annular portion 19. A plurality of main rope grooves 21 (FIG. 3) extending in a circumferential direction of the sheave portion 18 are provided in an outer periphery portion of the sheave portion 18. The respective main ropes 6 are looped around the sheave portion 18 along the main rope grooves 21.

A motor 22 as a driving portion for rotating the traction sheave 4 is provided between the annular portion 19 and the traction machine case 16 (FIG. 3). The motor 22 has a plurality of permanent magnets 23 fixed to an outer peripheral surface of the annular portion 19, and a stator 24 provided on an inner peripheral surface of a support frame 16 so as to face the permanent magnets 23. The traction sheave 4 and the respective permanent magnets 23 are integrally rotated through energization of the stator 24. The traction machine body 3 has the traction machine case 16, the main shaft 17, and the motor 22.

The sheave brake devices 9 are disposed within the recess portion 20, namely, inside the annular portion 19. The rope catch device 10 is disposed radially outward of the sheave portion 18. In this example, the rope catch device 10 is disposed above the sheave portion 18. The sheave brake devices 9 and the rope catch device 10 are supported by the traction machine case 16, respectively. Further, the sheave brake devices 9 and the rope catch device 10 are disposed within the traction machine case 16.

The sheave brake devices 9, which are provided as a pair, are disposed symmetrically with respect to the main shaft 17. The sheave brake devices 9 have sheave brake movable bodies 25 as braking members movable into contact with and away from an inner peripheral surface of the annular portion 19, sheave brake urging springs 26 (FIG. 2) for urging the sheave brake movable bodies 25 in a direction such that the sheave brake movable bodies 25 move into contact with the inner peripheral surface of the annular portion 19, and sheave brake electromagnets 27 for displacing the sheave brake movable bodies 25 against the urging by the sheave brake urging springs 26 in a direction such that the sheave brake movable bodies 25 are separated from the inner peripheral surface of the annular portion 19, respectively.

The sheave brake movable bodies 25 have movable members 28, and brake linings 29 provided on the movable members 28 to move into contact with and away from the inner peripheral surface of the annular portion 19 through displacement of the movable members 28, respectively. One end of each of the movable members 28 is turnably provided in the traction machine case 16 by means of a pin 30 (FIG. 2). When each of the movable members 28 is turned around the pin 30, a corresponding one of the brake linings 29 is thereby moved into contact with and away from the inner peripheral surface of the annular portion 19.

Each of the sheave brake urging springs 26 provided with the sheave brake devices 9 is disposed between the other ends of the movable members 28. Each of the sheave brake electromagnets 27 is disposed between the main shaft 17 and a corresponding one of the movable members 28 (FIG. 2). When each of the sheave brake electromagnets 27 is energized, a corresponding one of the brake linings 29 is thereby separated from the inner peripheral surface of the annular portion 19. When each of the sheave brake electromagnets 27 is stopped from being energized, a corresponding one of the brake linings 29 is thereby moved into contact with the inner peripheral surface of the annular portion 19. When the respective brake linings 29 come into contact with the inner peripheral surface of the annular portion 19, the rotation of the traction sheave 4 is thereby braked. When the respective brake linings 29 are separated from the inner peripheral surface of the annular portion 19, the braking of the rotation of the traction sheave 4 is thereby canceled.

Figure 4:
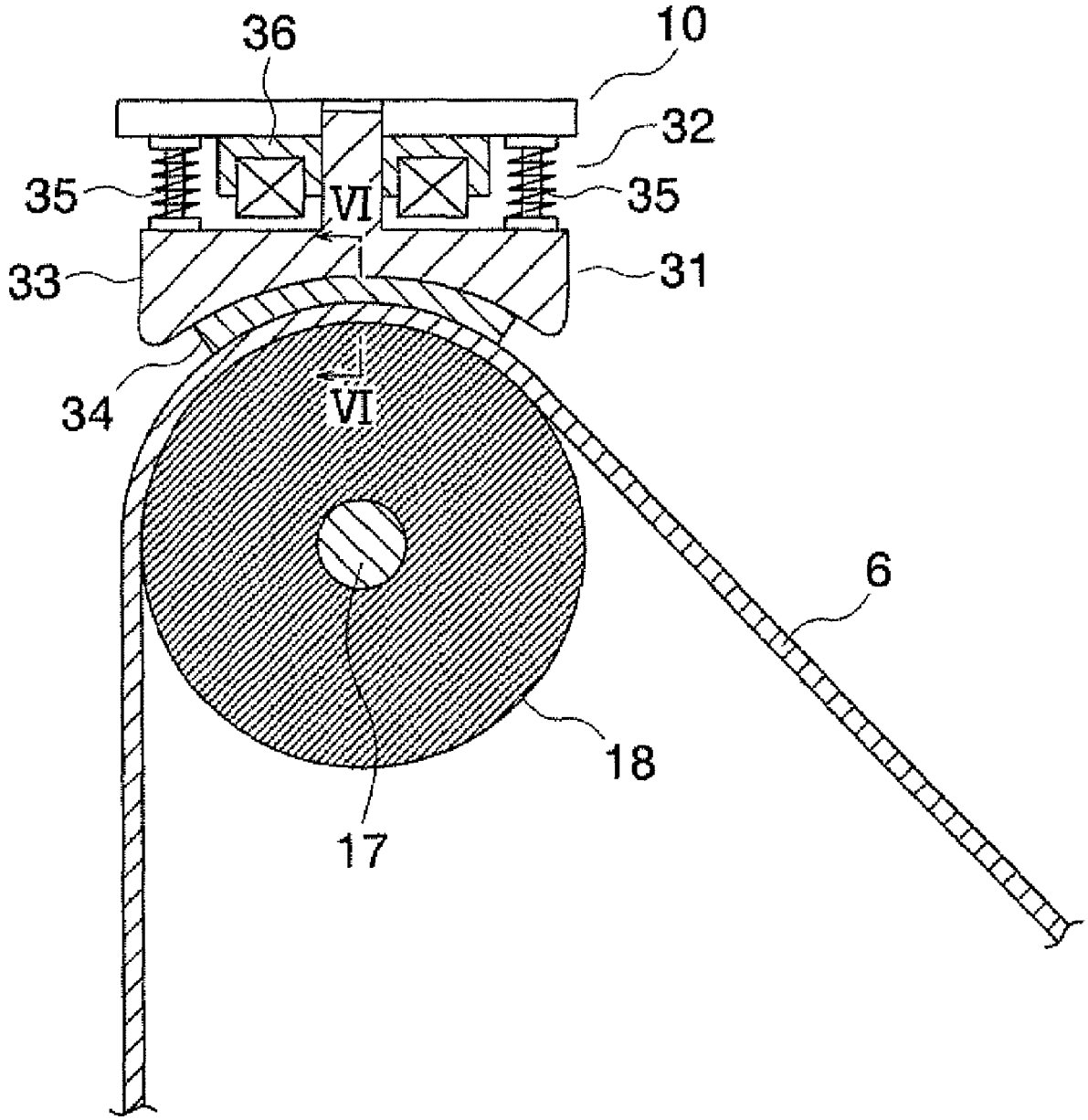
FIG. 4 is a sectional view taken along the line IV-IV of FIG. 3.
Figure 5:
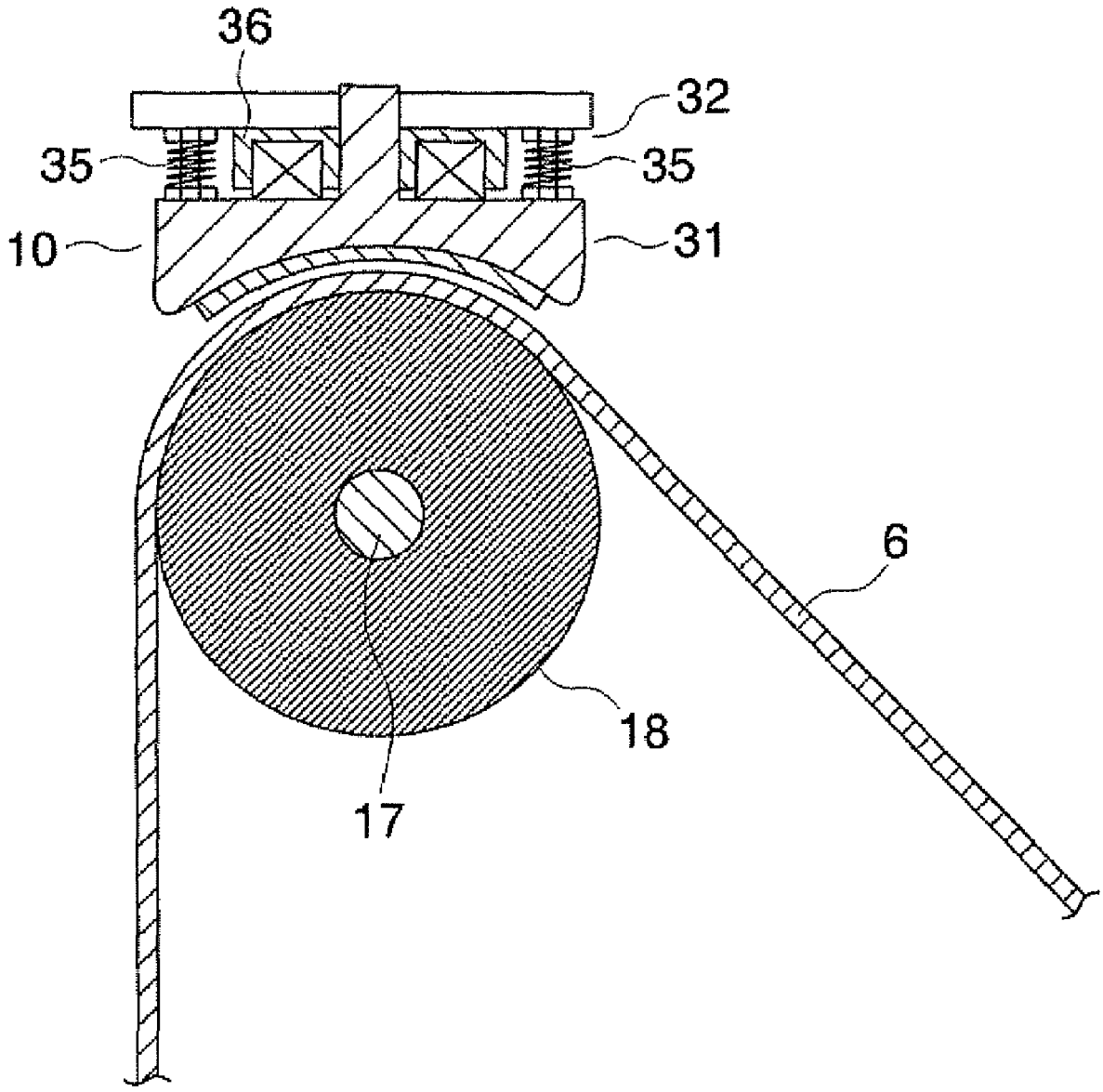
FIG. 5 is a sectional view at a time when a rope catch movable body of FIG. 4 is at an open position.

FIG. 4 is a sectional view taken along the line IV-IV of FIG. 3. FIG. 5 is a sectional view at a time when a rope catch movable body 31 of FIG. 4 is at an open position. Incidentally, FIG. 4 is a sectional view at a time when the rope catch movable body 31 is at a braking position. Referring to FIGS. 4 and 5, the rope catch device 10 has the rope catch movable body 31 as a braking member displaceable in a radial direction of the sheave portion 18, and a displacement device 32 for displacing the rope catch movable body 31. The rope catch movable body 31 has a movable member 33, and a brake lining 34 provided on the movable member 33.

The rope catch movable body 31 is displaceable between the braking position (FIG. 4) where the rope catch movable body 31 is pressed against the traction sheave 4 via the respective main ropes 6, and the open position (FIG. 5) where the rope catch movable body 31 is separated from the respective main ropes 6. The brake lining 34 is in contact with the respective main ropes 6 when the rope catch movable body 31 is at the braking position.

The displacement device 32 has rope catch urging springs 35 for urging the rope catch movable body 31 toward the sheave portion 13, and rope catch electromagnets 36 for displacing the rope catch movable body 31 away from the sheave portion 18 against the urging by the rope catch urging springs 35.

The rope catch movable body 31 is displaced between the braking position and the open position by the displacement device 32. That is, the rope catch movable body 31 is displaced to the braking position through the urging by the rope catch urging springs 35. When the rope catch electromagnets 36 are energized, the rope catch movable body 31 is thereby displaced to the position where the rope catch movable body 31 is separated against the urging by the rope catch urging springs 35.

Figure 6:
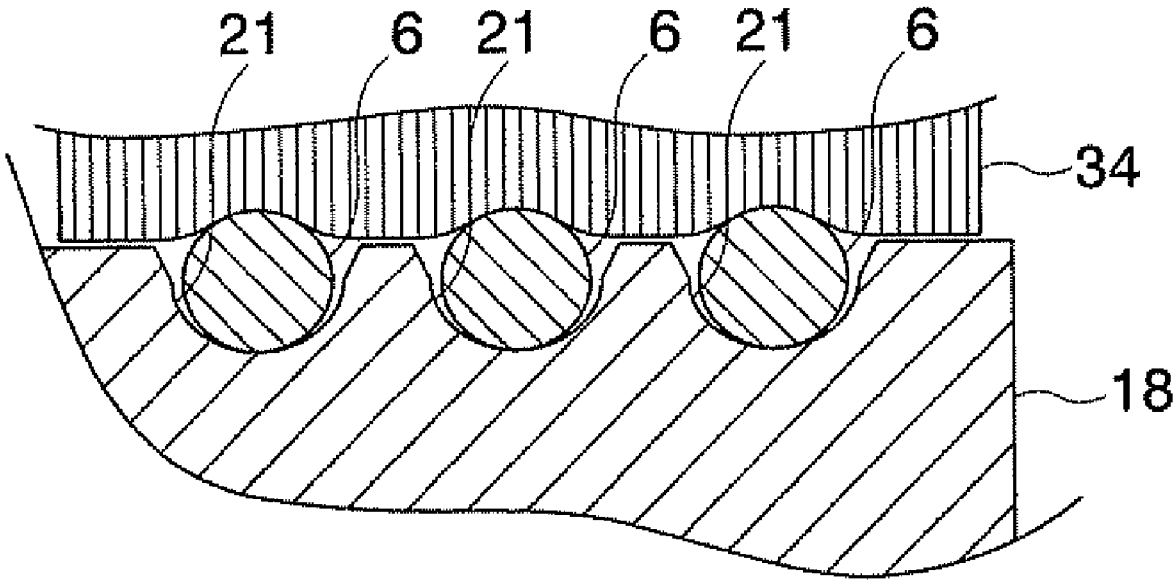
FIG. 6 is a sectional view taken along the line VI-VI of FIG. 4.

FIG. 6 is a sectional view taken along the line VI-VI of FIG. 4. Referring to FIG. 6, when the rope catch movable body 31 is at the braking position, the brake lining 34 is deformed along surfaces of the respective main ropes 6 through the urging by the rope catch urging springs 35. A force for pressing each of the main ropes 6 against a corresponding one of the main rope grooves 21 has been increased through displacement of the rope catch movable body 31 to the braking position. When the rope catch movable body 31 is displaced to the braking position, a braking force is thereby applied to each of the main ropes 6. That is, when the respective main ropes 6 are pressed against the traction sheave 4 by the rope catch movable body 31, the movement of the respective main ropes 6 is thereby braked.

Next, an operation will be described. In the determination circuit 14, a speed difference between rotational speeds of the traction sheave 4 and the deflector pulley 5 is constantly calculated based on pieces of information from the traction sheave encoder 11 and the deflector pulley encoder 12.

When the speed difference calculated in the determination circuit 14 is smaller than the set reference value, the determination information indicating the normal determination is transmitted from the determination circuit 14 to the control circuit 15. When the determination information indicating the normal determination is input to the control circuit 15, the sheave brake electromagnets 27 and the rope catch electromagnets 36 are energized respectively through the control performed by the control circuit 15. Thus, the sheave brake movable bodies 25 are separated from the annular portion 19, so the rope catch movable body 31 is displaced to the open position. Thus, the braking of the rotation of the traction sheave 4 and the braking of the movement of the respective main ropes 6 have been canceled, respectively.

For example, in a case where the speed difference calculated in the determination circuit 14 has become equal to or larger than the set reference value due to the occurrence of slippage between the respective main ropes 6 and the traction sheave 4, the determination information indicating the abnormal determination is transmitted from the determination circuit 14 to the control circuit 15. When the determination information indicating the abnormal determination is input to the control circuit 15, the sheave brake electromagnets 27 and the rope catch electromagnets 36 are stopped from being energized respectively through the control performed by the control circuit 15. Thus, the sheave brake movable bodies 25 are each displaced to a position for contact with the annular portion 19, and the rope catch movable body 31 is displaced to the braking position. Thus, the rotation of the traction sheave 4 and the movement of the respective main ropes 6 are braked respectively, so the car 7 and the counterweight 8 are stopped from running.

When the rotation of the traction sheave 4 is stopped through normal operation control, the stop information is transmitted from the determination circuit 14 to the control circuit 15. When the stop information is input to the control circuit 15 as well, the sheave brake devices 9 and the rope catch device 10 are controlled in the same manner as in a case where the information indicating the abnormal determination is input by the control circuit 15. That is, through the control performed by the control circuit 15, the sheave brake movable bodies 25 are each displaced to the position for contact with the annular portion 19, and the rope catch movable body 31 is displaced to the braking position. Thus, the stop positions of the car 7 and the counterweight 8 are maintained.

In the elevator apparatus constructed as described above, the speed difference between the rotational speeds of the traction sheave 4 and the deflector pulley 5 is compared with the set reference value to determine whether or not there is an abnormality in the elevator. Therefore, the occurrence of slippage between the traction sheave 4 and the respective main ropes 6 can be detected, so the occurrence of inconveniences resulting from the slippage between the traction sheave 4 and the respective main ropes 6, for example, the inability of the car 7 to run resulting from the idling of the traction sheave 4 and a rise or fall of the car 7 resulting from slippage of the respective main ropes 6 during stoppage of the traction sheave 4 can be prevented.

It should be noted herein that the traction sheave 4 rotates to move the respective main ropes 6 to which large loads are applied respectively from the car 7 and the counterweight 8. On the other hand, the deflector pulley 5 is rotated through the movement of the respective main ropes 6. Accordingly, slippage is far more likely to occur between the traction sheave 4 and the respective main ropes 6 than between the deflector pulley 5 and the respective main ropes 6. Thus, the slippage between the deflector pulley 5 and the respective main ropes 6 can be regarded as nonexistent, and the rotational speed of the deflector pulley 5 can be regarded as the moving speed of the respective main ropes 6. That is, slippage between the traction sheave 4 and the respective main ropes 6 can be detected by calculating the speed difference between the rotational speeds of the traction sheave 4 and the deflector pulley 5.

The rope catch device 10 has the rope catch movable body 31 displaceable between the braking position where the rope catch movable body 31 is pressed against the sheave portion 18 via the respective main ropes 6 and the open position where the rope catch movable body 31 is separated from the respective main ropes 6, and the displacement device 32 for displacing the rope catch movable body 31 between the braking position and the open position. Therefore, the movement of the respective main ropes 6 can be braked due to frictional forces between the rope catch movable body 31 and the respective main ropes 6 as well as frictional forces between the traction sheave 4 and the respective main ropes 6. Accordingly, the respective main ropes 6 can be braked more reliably, so the occurrence of inconveniences resulting from slippage between the traction sheave 4 and the respective main ropes 6 can be prevented. Further, the traction sheave 4 is used to grip the respective main ropes 6. Therefore, the number of parts of the rope catch device 10 can be reduced, and the installation space for the rope catch device 10 can also be reduced.

When the determination circuit 14 determines that there is an abnormality in the elevator, the control circuit 15 controls the displacement device 32 such that the rope catch movable body 31 is displaced to the braking position. Therefore, when slippage occurs between the traction sheave 4 and the respective main ropes 6, the respective main ropes 6 can be braked more reliably, so the car 7 and the counterweight 8 can be more reliably stopped from running. Thus, the occurrence of inconveniences resulting from slippage between the traction sheave 4 and the respective main ropes 6 can be prevented.

When the traction sheave 4 remains stopped from rotating, the operation control device 13 controls the sheave brake devices 9 such that the sheave brake movable bodies 25 are pressed against the annular portion 19, and controls the rope catch device 10 such that the rope catch movable body 31 is displaced to the braking position. Therefore, when, for example, a passenger gets on or off the car 7, the car 7 can be prevented from being raised or lowered due to slippage between the respective main ropes 6 and the traction sheave 4. As a result, the occurrence of inconveniences resulting from slippage between the respective main ropes 6 and the traction sheave 4 can be prevented.

In the foregoing example, the traction sheave 4 has the sheave portion 18 and the annular portion 19 that are integrated with each other. However, the sheave portion 18 and the annular portion 19 may be separated from each other. In this case, the main shaft 17 is rotatably provided in the traction machine case 16. The sheave portion 18 and the annular portion 19 are fixed to the main shaft 17 respectively in an integrally rotatable manner.

Figure 7:
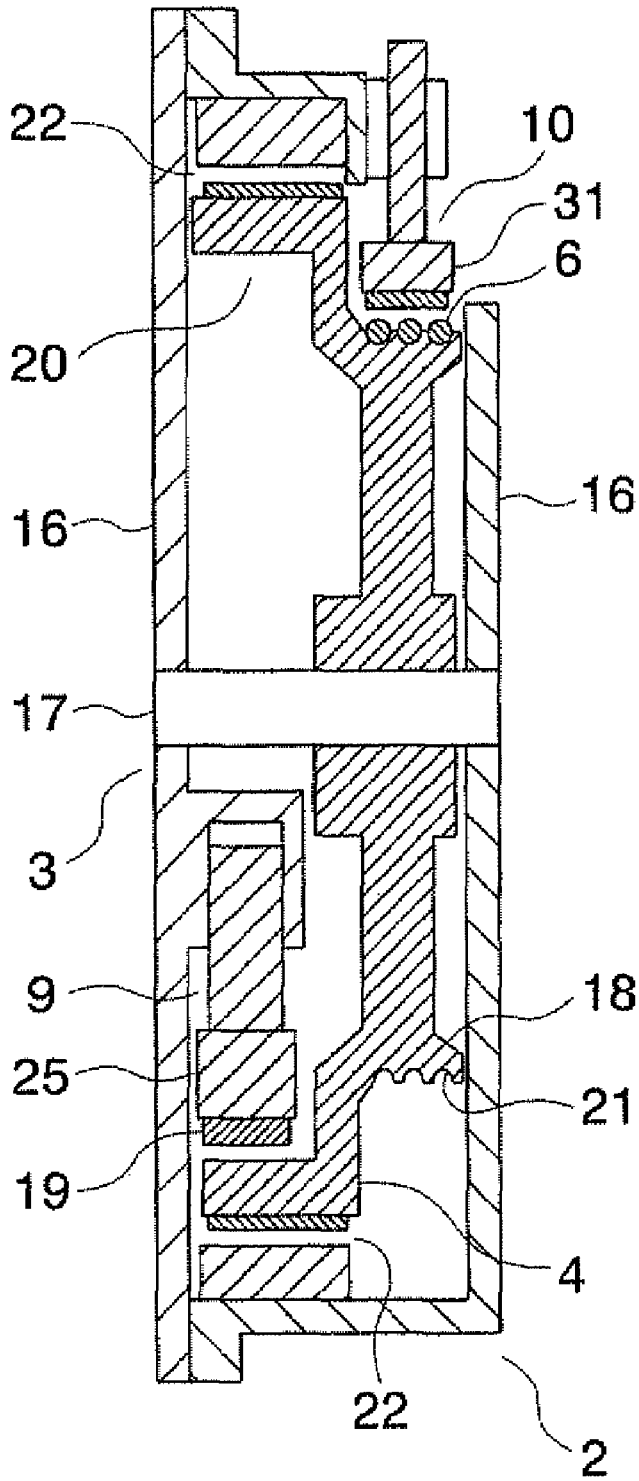
FIG. 7 is a sectional view showing another example of a traction machine according to Embodiment 1 of the present invention.

In the foregoing example, the rope catch device 10 is disposed within the traction machine case 16. However, as shown in FIG. 7, part of the traction machine case 16 may be opened to expose the rope catch device 10 to the outside. With this construction, the maintenance and inspection of the rope catch device 10 can be carried out with ease.

Embodiment 2

Figure 8:
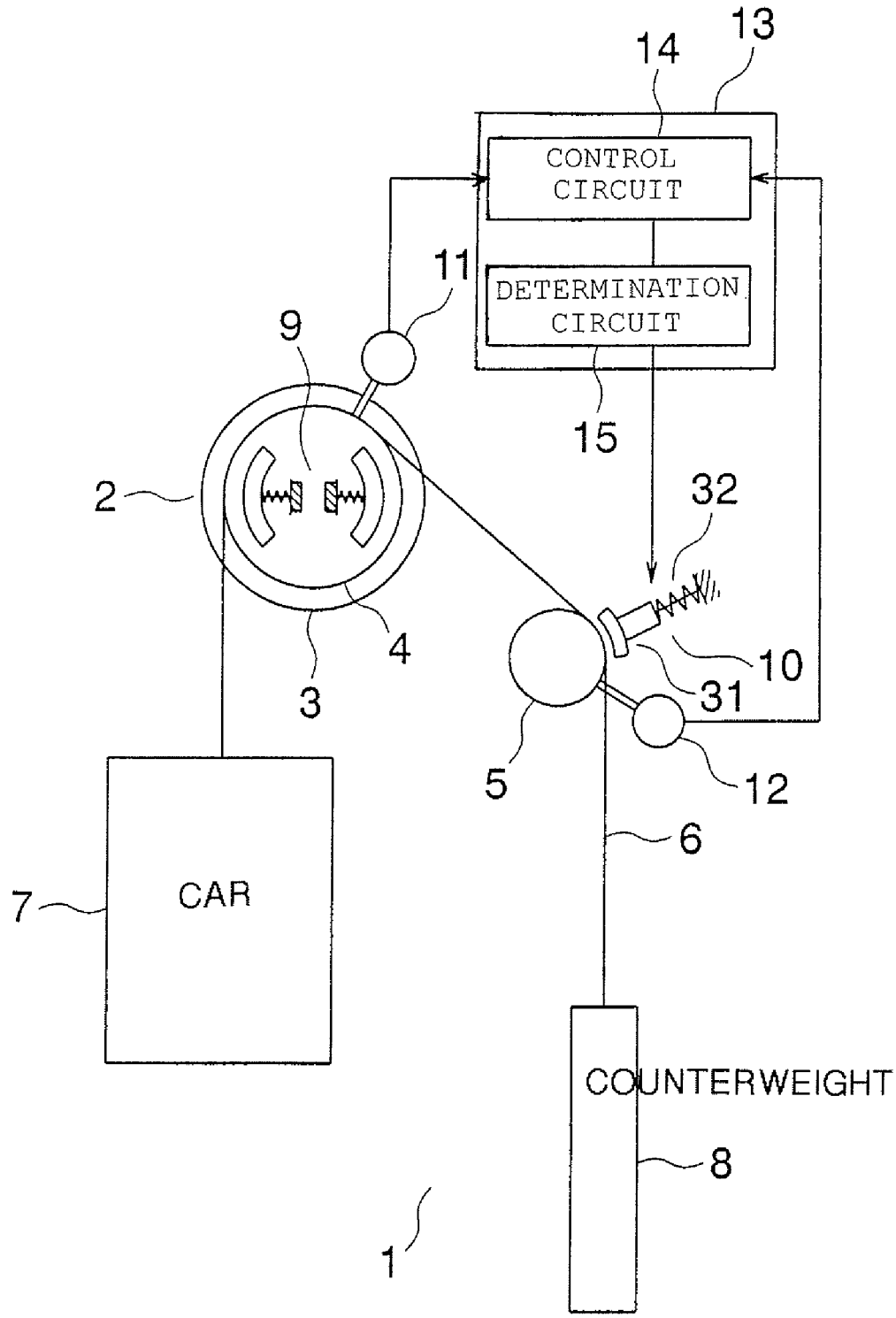
FIG. 8 is a schematic view showing an elevator apparatus according to Embodiment 2 of the present invention.

FIG. 8 is a schematic view showing an elevator apparatus according to Embodiment 2 of the present invention. Referring to FIG. 8, the rope catch device 10 is installed close to the deflector pulley 5. The rope catch movable body 31 is displaceable between a braking position where the rope catch movable body 31 is pressed against the deflector pulley 5 via the respective main ropes 6 and an open position where the rope catch movable body 31 is separated from the respective main ropes 6. The rope catch movable body 31 is displaced between the braking position and the open position by the displacement device 32. The displacement device 32 is controlled by the control circuit 15. Embodiment 2 of the present invention is identical to Embodiment 1 of the present invention in other constructional details and other operational details.

In the elevator apparatus constructed as described above, the rope catch movable body 31 is pressed against the deflector pulley 5 via the respective main ropes 6 to brake the movement of the respective main ropes 6. Therefore, the movement of the respective main ropes 6 can be braked due to frictional forces between the rope catch movable body 31 and the respective main ropes 6, so the respective main ropes 6 can be braked more reliably as is the case with Embodiment 1 of the present invention. Further, a reduction in cost and a reduction in the installation space for the rope catch device 10 can also be achieved as a result of a reduction in the number of parts of the rope catch device 10.

In the foregoing example, the movement of the respective main ropes 6 is braked by the single rope catch device 10. However, the respective main ropes 6 may be braked by two rope catch devices. In this case, one of the rope catch devices presses the rope catch movable body against the traction sheave 4 via the respective main ropes 6 and hence brakes the respective main ropes 6. The other rope catch device presses the rope catch movable body against the deflector pulley 5 via the respective main ropes 6 and hence brakes the respective main ropes 6.

In the foregoing example, the deflector pulley 5 itself is not braked. However, the deflector pulley 5 may be provided with a brake device for braking the rotation of the deflector pulley 5. In this case, the brake device is disposed inside the deflector pulley 5. The brake device is constructed in the same manner as the sheave brake devices 9.

In the foregoing example, the rope catch movable body 31 is displaced into contact with and away from the deflector pulley 5. However, in a case where, for example, sheaves around which the respective main ropes 6 are looped (e.g., return pulley provided in the upper portion of the hoistway 1 to turn the directions of the respective main ropes 6, and suspension pulleys provided on the car 7 and the counterweight 8 to suspend the car 7 and the counterweight 8 respectively) are provided within the hoistway 1 in addition to the traction sheave 4 and the deflector pulley 5, the rope catch device 10 may be disposed such that the rope catch movable body 31 is moved into contact with and away from those sheaves. Those sheaves may be provided with brake devices for braking the rotation thereof respectively.

Embodiment 3

Figure 9:
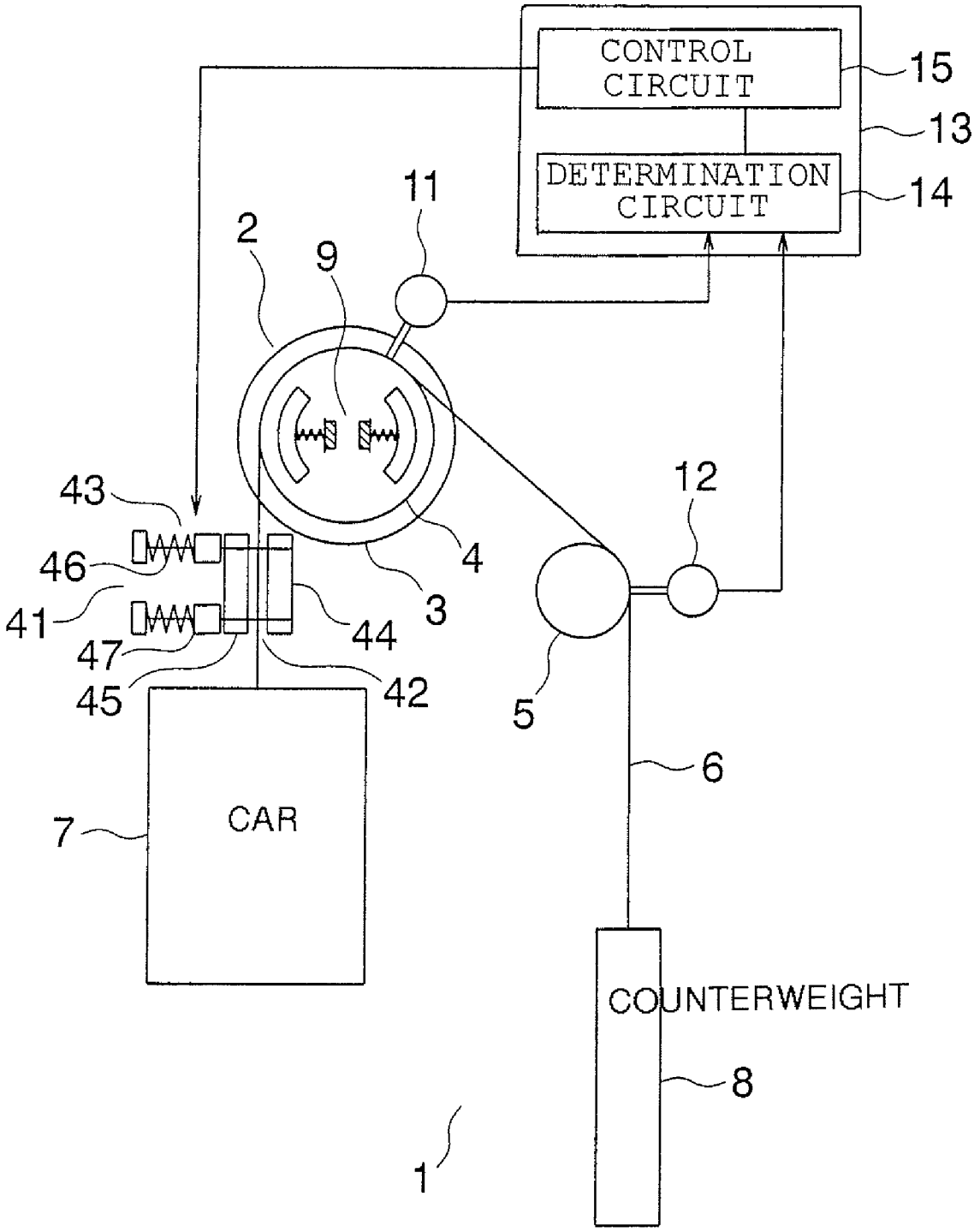
FIG. 9 is a schematic view showing an elevator apparatus according to Embodiment 3 of the present invention.

FIG. 9 is a schematic view showing an elevator apparatus according to Embodiment 3 of the present invention. Referring to FIG. 9, a rope catch device 41 for gripping the respective main ropes 6 to brake the movement thereof is provided below the traction machine 2. The rope catch device 41 has a grip portion 42 for gripping the respective main ropes 6, and a displacement device 43 for driving the grip portion 42.

The grip portion 42 has a fixed portion 44 fixed with respect to the traction machine 2, and a movable portion 45 as a braking member displaceable into contact with and away from the fixed portion 44. The movable portion 45 is displaceable between a braking position where the movable portion 45 is pressed against the fixed portion 44 via the respective main ropes 6 and an open position where the movable portion 45 is separated from the respective main ropes 6. Braking forces are applied to the main ropes 6 respectively when the movable portion 45 is at the braking position. That is, the movement of the respective main ropes 6 is braked due to frictional forces between the movable portion 45 and the respective main ropes 6 and frictional forces between the fixed portion 44 and the respective main ropes 6 when the movable portion 45 is at the braking position. The car 7 and the counterweight 8 are stopped through the braking of the respective main ropes 6. The braking of the respective main ropes 6 is canceled when the movable portion 45 is at the open position.

The displacement device 43 displaces the movable portion 45 between the braking position and the open position. The displacement device 43 has urging springs 46 for urging the movable portion 45 toward the fixed portion 44, and electromagnets 47 for displacing the movable portion 45 away from the fixed portion 44 against the urging by the urging springs 46. When the electromagnets 47 are energized, the movable portion 45 is thereby displaced to the open position. When the electromagnets 47 are stopped from being energized, the movable portion 45 is thereby displaced to the braking position. Embodiment 3 of the present invention is identical to Embodiment 1 of the present invention in other constructional details.

Next, the operation of the rope catch device 41 will be described. In a case where the determination information indicating the normal determination has been transmitted from the determination circuit 14 to the control circuit 15, the electromagnets 47 are energized in the rope catch device 41 through the control performed by the control circuit 15, so the movable portion 45 is displaced to the open position. Thus, the braking of the movement of the respective main ropes 6 is cancelled, so the car 7 and the counterweight 8 are caused to run through the rotation of the traction sheave 4.

When the determination information indicating the abnormal determination is transmitted from the determination circuit 14 to the control circuit 15, the electromagnets 47 are stopped from being energized in the rope catch device 41 through the control performed by the control circuit 15. Thus, the movable portion 45 is displaced from the open position to the braking position, so the respective main ropes 6 are gripped by the grip portion 42. Thus, the movement of the respective main ropes 6 is braked, so the car 7 and the counterweight 8 are stopped from running.

When the stop information is transmitted from the determination circuit 14 to the control circuit 15, the electromagnets 47 are stopped from being energized in the rope catch device 41 through the control performed by the control circuit 15, so the movable portion 45 is displaced to the braking position. Thus, the respective main ropes 6 are gripped by the grip portion 42, so the stop positions of the car 7 and the counterweight 8 are maintained.

In the elevator apparatus constructed as described above, the respective main ropes 6 are gripped between the fixed portion 44 and the movable portion 45, so the movement of the respective main ropes 6 is braked. Therefore, the respective main ropes 6 can be braked more reliably, and the occurrence of inconveniences resulting from slippage between the traction sheave 4 and the respective main ropes 6 can be prevented.

In the foregoing example, the rope catch device 41 is disposed below the traction machine 2. However, it is sufficient that the grip portion 42 grips the respective main ropes 6 to brake the movement thereof, so the rope catch device 41 is not necessarily required to be located below the traction machine 2. Accordingly, the rope catch device 41 may be disposed, for example, below the deflector pulley 5 or between the traction sheave 4 and the deflector pulley 5.

Embodiment 4

In the foregoing Embodiment 1 of the present invention, the determination circuit 14 determines only whether or not there is an abnormality in the elevator, but does not make a determination on the level of the abnormality. However, the determination circuit 14 may also make a determination on the level of the abnormality stepwise.

That is, a high-level set value, which is larger than the set reference value, is additionally set in the determination circuit 14. When the calculated speed difference is equal to or larger than the set reference value and smaller than the high-level set value, the determination circuit 14 determines that there is a low-level abnormality. When the calculated speed difference is equal to or larger than the high-level set value, the determination circuit 14 determines that there is a high-level abnormality. When it is determined that there is an abnormality in the elevator, the determination circuit 14 transmits determination information indicating either the low-level abnormality or the high-level abnormality to the control circuit 15.

When the determination information indicating the low-level abnormality is input to the control circuit 15, the control circuit 15 controls the traction machine 2 such that the car 7 stops at a nearest floor. When the determination information indicating the high-level abnormality is input to the control circuit 15, the control circuit 15 controls the displacement device 32 such that the rope catch movable body 31 is displaced to the braking position. That is, the control circuit 15 performs different kinds of control according to the types of the input determination information respectively. The nearest floor is defined herein as a floor located closest to the position of the car 7 at a time when the determination circuit 14 determines that there is an abnormality in the elevator. Embodiment 4 of the present invention is identical to Embodiment 1 of the present invention in other constructional details.

Next, an operation will be described. When the determination information indicating the low-level abnormality is transmitted from the determination circuit 14 to the control circuit 15, the traction machine 2 is controlled by the control circuit 15, so the car 7 is stopped at the nearest floor. When the car 7 is stopped at the nearest floor, the stop information is output from the determination circuit 14 to the control circuit 15. After that, the sheave brake devices 9 and the rope catch device 10 are operated respectively through the control performed by the control circuit 15, so the sheave brake movable bodies 25 are each displaced to the position for contact with the annular portion 19, and the rope catch movable body 31 is displaced to the braking position. Thus, the respective main ropes 6 are braked, so the stop position of the car 7 is maintained.

When the determination information indicating the high-level abnormality is transmitted from the determination circuit 14 to the control circuit 15, the car 7 is not stopped at the nearest floor by the traction machine 2, but the sheave brake devices 9 and the rope catch device 10 are operated through the control performed by the control circuit 15. That is, when the determination information indicating the high-level abnormality is input to the control circuit 15, the sheave brake devices 9 and the rope catch device 10 are immediately operated through the control performed by the control circuit 15, so the sheave brake movable bodies 25 are each displaced to the position for contact with the annular portion 19, and the rope catch movable body 31 is displaced to the braking position. Thus, the rotation of the traction sheave 4 and the movement of the respective main ropes 6 are braked respectively, so the car 7 is stopped as an emergency measure.

In the elevator apparatus constructed as described above, the set reference value and the high-level set value larger than the set reference value are set in the determination circuit 14. When the calculated speed difference is equal to or larger than the set reference value and smaller than the high-level set value, the determination circuit 14 determines that there is a low-level abnormality. When the calculated speed difference is equal to or larger than the high-level set value, the determination circuit 14 determines that there is a high-level abnormality. The control circuit 15 performs the different kinds of control in response to the determination indicating the occurrence of the low-level abnormality and the determination indicating the occurrence of the high-level abnormality respectively. Therefore, when the level of the abnormality in the elevator is low, the car 7 can be stopped at the nearest floor, so a rescue of passengers within the car 7 and the like can be performed in a short period of time. Thus, the time required for the recovery of the elevator can be shortened.

When the determination circuit 14 determines that there is a low-level abnormality, the control circuit 15 controls the traction machine 2 such that the car 7 stops at the nearest floor. When the determination circuit 14 determines that there is a high-level abnormality, the control circuit 15 controls the displacement device 32 such that the rope catch movable body 31 is displaced to the braking position. Therefore, when the level of the abnormality in the elevator is low, the car 7 can be stopped at the nearest floor, so the rescue of passengers within the car 7 and the like can be performed in a short period of time. When the level of the abnormality in the elevator is high, the car 7 can be stopped immediately and more reliably.

Embodiment 5

In the aforementioned Embodiment 4 of the present invention, it is determined based on the speed difference between the rotational speeds of the traction sheave 4 and the deflector pulley 5 whether or not there is an abnormality in the elevator. However, it is also appropriate to determine based on the rotational speed of the deflector pulley 5 as well as the speed difference between the rotational speeds whether or not there is an abnormality in the elevator.

That is, in addition to the set reference value, an overspeed reference value for the rotational speed of the deflector pulley 5 is set in the determination circuit 14. The determination circuit 14 calculates a speed difference between rotational speeds of the traction sheave 4 and the deflector pulley 5 based on pieces of information from the traction sheave encoder 11 and the deflector pulley encoder 12, and compares the calculated speed difference with the set reference value to determine whether or not there is an abnormality in the elevator. The determination circuit 14 calculates the rotational speed of the deflector pulley 5 based on the information from the deflector pulley encoder 12, and compares the calculated rotational speed with the overspeed reference value to determine whether or not there is an abnormality in the elevator.

That is, when the speed difference between the rotational speeds of the traction sheave 4 and the deflector pulley 5 is smaller than the set reference value, the determination circuit 14 makes a normal determination. When the speed difference is equal to or larger than the set reference value, the determination circuit 14 makes an abnormal determination. Further, when the rotational speed of the deflector pulley 5 is lower than the overspeed reference value, the determination circuit 14 makes a normal determination. When the rotational speed of the deflector pulley 5 is equal to or higher than the overspeed reference value, the determination circuit 14 makes an abnormal determination. Embodiment 5 of the present invention is identical to Embodiment 1 of the present invention in other constructional details.

Next, an operation will be described. When the speed difference between the rotational speeds of the traction sheave 4 and the deflector pulley 5 is equal to or larger than the set reference value or when the rotational speed of the deflector pulley 5 is equal to or higher than the overspeed reference value, the determination circuit 14 makes an abnormal determination, and the determination information indicating the abnormal determination is transmitted from the determination circuit 14 to the control circuit 15. Embodiment 5 of the present invention is identical to Embodiment 4 of the present invention in the following operational details.

When the speed difference between the rotational speeds of the traction sheave 4 and the deflector pulley 5 is smaller than the set difference value and the rotational speed of the deflector pulley 5 is lower than the overspeed reference value, the determination circuit 14 makes a normal determination, and the determination information indicating the normal determination is transmitted from the determination circuit 14 to the control circuit 15. Embodiment 5 of the present invention is identical to Embodiment 4 of the present invention in the following operational details.

In the elevator apparatus constructed as described above, it is determined based on the rotational speed of the deflector pulley 5 as well as the speed difference between the rotational speeds of the traction sheave 4 and the deflector pulley 5 whether or not there is an abnormality in the elevator. Therefore, the occurrence of inconveniences resulting from slippage between the traction sheave 4 and the respective main ropes 6 can be prevented. Also, even when the speed of the car 7 becomes abnormally high, the car 7 can be stopped more reliably.

In the aforementioned respective embodiments of the present invention, the rope catch movable body 31 is displaced to the braking position by the rope catch urging springs 35. However, the rope catch movable body 31 may be displaced to the braking position by, for example, a hydraulic power unit, a pneumatic power unit, an electromagnet, or an electric motor.

In the aforementioned respective embodiments of the present invention, the rope catch movable body 31 is displaced to the open position by the rope catch electromagnets 36. However, the rope catch movable body 31 may be displaced to the open position by, for example, an urging spring, a hydraulic power unit, a pneumatic power unit, or an electric motor. Alternatively, the rope catch device 10 may be fitted with a lever for being manually turned to displace the rope catch movable body 31 to the open position.

In the aforementioned respective embodiments of the present invention, the magnitude of the pressing force applied to each of the main ropes 6 from the rope catch movable body 31 located at the braking position cannot be adjusted. However, the magnitude of the pressing force applied to each of the main ropes 6 from the rope catch movable body 31 may be adjustable using, for example, a hydraulic power unit, or a pneumatic power unit. The magnitude of the braking force applied to each of the main ropes 6 may be adjusted by displacing the rope catch movable body 31 between the braking position and the open position a plurality of times until the respective main ropes 6 stop. With this construction, the deceleration of the car 7 at the time of braking can be adjusted, so the car 7 can be prevented from being stopped abruptly. Accordingly, a shock caused to the car 7 at the time of braking can be absorbed.

In the aforementioned respective embodiments of the present invention, when the determination circuit 14 determines that there is an abnormality in the elevator, a warning may be issued from the operation control device 13 to a remote monitoring room for monitoring the operation of the elevator. With this construction, a supervisor in the remote monitoring room can be informed of the abnormality in the elevator at an early stage, so a measure against the abnormality in the elevator can be taken without delay.

The invention claimed is:

1. An elevator apparatus, comprising:

a traction machine having a traction machine body and a traction sheave rotated by the traction machine body;

a driven sheave disposed apart from the traction sheave;

a main rope looped around the traction sheave and the driven sheave;

a car and a counterweight suspended by the main rope;

a driving-side speed detecting portion for detecting rotational speed of the traction sheave;

a driven-side speed detecting portion for detecting rotational speed of the driven sheave; and an operation control device having a determination portion for calculating speed difference between the rotational speeds of the traction sheave and the driven sheave based on information from the driving-side speed detecting portion and the driven-side speed detecting portion, and comparing the speed difference calculated with a fixed reference value, set in advance, to determine presence or absence of an abnormality in an elevator, and a control portion for controlling operation of the elevator based on information from the determination portion.

2. The elevator apparatus according to claim 1, wherein:

the determination portion has a high-level set value, which is larger than the fixed reference value, additionally set therein;

the determination portion determines that there is a low-level abnormality when the speed difference is equal to or larger than the fixed reference value and smaller than the high-level set value, and determines that there is a high-level abnormality when the speed difference is equal to or larger than the high-level set value; and the control portion performs different controls in response to the determination indicating the low-level abnormality and the determination indicating the high-level abnormality respectively.

3. The elevator apparatus according to claim 2, further comprising:

a rope catch device having a braking member displaceable between a braking position, in which the braking member is pressed against at least one of the traction sheave and the driven sheave via the main rope, and an open position, in which the braking member is separated from the main rope, and a displacement device for displacing the braking member between the braking position and the open position, and for applying a braking force to the main rope through displacement of the braking member to the braking position, wherein the control portion controls the traction machine such that the car stops when the determination portion determines that there is a low-level abnormality, and controls the displacement device such that the braking member is displaced to the braking position when the determination portion determines that there is a high-level abnormality.

4. The elevator apparatus according to claim 1, further comprising:

a rope catch device having a braking member displaceable between a braking position, in which the braking member is pressed against at least one of the traction sheave, and the driven sheave via the main rope, and an open position, in which the braking member is separated from the main rope, and a displacement device for displacing the braking member between the braking position and the open position, and for applying a braking force to the main rope through displacement of the braking member to the braking position, wherein the control portion controls the displacement device such that the braking member is displaced to the braking position when the determination portion determines that there is an abnormality in the elevator.

5. The elevator apparatus according to claim 3, wherein the main rope receives a pressing force, which can be adjusted by the displacement device, when the braking member is displaced to the braking position.

6. The elevator apparatus according to claim 4, wherein the main rope receives a pressing force, which can be adjusted by the displacement device, when the braking member is displaced to the braking position.

7. The elevator apparatus according to claim 3, wherein the control portion controls the traction machine such that the car stops at a nearest floor when the determination portion determines that there is a low-level abnormality.

* * * * *